United States Patent [19]

Lawrence

[11] 4,068,794

[45] Jan. 17, 1978

[54] CONTAINER PARTICULARLY, BUT NOT EXCLUSIVELY FOR USE IN SHIPPING PERISHABLES

[75] Inventor: Bryan Lawrence, Noordhoek, Cape Province, South Africa

[73] Assignee: The Deciduous Fruit Board, Cape Town, Cape Province, South Africa

[21] Appl. No.: 726,435

[22] Filed: Sept. 24, 1976

[30] Foreign Application Priority Data

Sept. 25, 1975 South Africa ..... 75/6116

[51] Int. Cl.[2] ..... B65D 5/02; B65D 61/00

[52] U.S. Cl. ..... 229/23 R; 229/44 R

[58] Field of Search ..... 229/33, 23 C, DIG. 11, 229/34 R, 44 R

[56] References Cited

U.S. PATENT DOCUMENTS

| | | | |
|---|---|---|---|
| 3,373,921 | 3/1968 | Crane | 229/23 R |
| 3,463,378 | 8/1969 | Van Daalen | 229/23 R X |
| 3,487,991 | 1/1970 | Stern | 229/23 R |
| 3,659,774 | 5/1972 | Mielke | 229/23 R X |
| 3,899,121 | 8/1975 | Herbetko | 229/23 R |
| 3,915,372 | 10/1975 | Crane | 229/23 R |
| 3,935,990 | 2/1976 | Crane | 229/34 R X |
| 3,935,991 | 2/1976 | Crane | 229/44 R |

*Primary Examiner*—Davis T. Moorhead

*Attorney, Agent, or Firm*—Burns, Doane, Swecker & Mathis

[57] ABSTRACT

A container for perishables such as fruit is disclosed. The container includes a tray having a base panel and upstanding side and end panels. At each end there are locking panels which are parallel to, and spaced inwardly from, the end panels. Between each end panel and the two adjacent locking panels there is a strengthening insert of wood, metal or synthetic plastics material. An end piece of inverted U-shape is provided to hold each composite end wall comprising a strengthening insert, an end panel and two locking panels in its erected condition. The spaced walls of the insert are located one on each side of the composite wall. Tongues (or right angled corner structures) project upwardly from the end pieces. Where tongues are provided, the base panel can have apertures therein for receiving the tongues of a lower container. Where right angled corner structures are provided, an upper container nests within the four structures of a lower container.

11 Claims, 9 Drawing Figures

CONTAINER PARTICULARLY, BUT NOT EXCLUSIVELY FOR USE IN SHIPPING PERISHABLES

This invention relates to containers particularly, but not exclusively, for use in the shipping of perishables such as fruit in palletised loads.

According to the present invention there is provided a container comprising a base panel, upstanding side panels and upstanding end panels, said panels forming an upwardly open tray, a locking panel at each end of each side panel, each pair of locking panels being parallel to and spaced from the adjacent end panel, a load bearing insert at each end of the container, each insert being between one of the end panels and the two adjacent locking panels, each insert, adjacent end panel and adjacent pair of locking panels forming a composite end wall of the container, and an end piece of inverted U-shape at each end of the container, the vertical walls of each end piece receiving the upper edge of one of the composite end walls therebetween, and elements which protrude upwardly at each end of the container with respect to the remainder of the container.

Preferably said elements are corner structures at each end of each piece, each corner structure being right-angled in plan view with a first portion thereof extending transversely of the container and a second portion thereof extending longitudinally of the container.

Said container can further include top flaps for closing the upwardly open tray after it has been filled. Each top flap can be connected to a side panel. At each end of each top flap there can be a tab, said tabs, when the flaps are in the closed position, projecting downwardly adjacent the composite end walls. Said end pieces can be formed with horizontally extending, upwardly open slots for receiving said tabs.

Those faces of the vertical walls of each end piece which are directed towards one another are formed with protrusions, said end panels and locking panels being formed with apertures which said protrusions enter as the end pieces are engaged with the composite end walls thereby to lock the end pieces to the composite end walls.

The end pieces are preferably injection mouldings of, for example, polypropylene but could, if desired, be metal pressings.

The stiffening inserts are preferably rectangular boards of timber or of a fabricated material such as chipboard. However, metal inserts and inserts of synthetic plastics material are possible. The essential feature of such inserts is that they prevent crushing of the ends of the container when it is subjected to a normal, maximum load. A container is so loaded when it is at the bottom of a palletised stack.

The base panel, side panels, end panels, locking flaps, locking panels and tabs are preferably punched from a single piece of sheet material which may be cardboard or corrugated board. Fold lines between the various panels, flaps and tabs can be produced during the punching operation.

For a better understanding of the present invention and to show how the same may be carried into effect, reference will now be made, by way of example, to the accompanying drawings in which.

Figure 1:
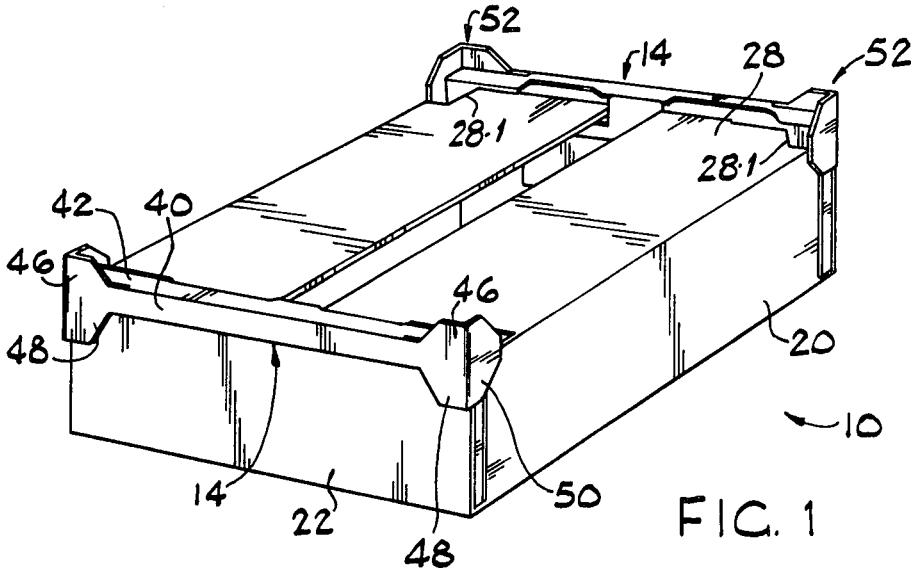
FIG. 1 is a pictorial view of a container for fruit or other perishable goods.

Referring firstly to FIG. 1, the container illustrated is generally designated 10 and is fabricated from five components. These are a blank 12 of paperboard or corrugated board (see FIG. 2), two end pieces 14 (see FIGS. 4 and 5), and two rectangular inserts 16 (see FIG. 3). These inserts can be of wood, pressed board such as chipboard, synthetic plastics material etc and must be capable of withstanding loading in the direction of the arrows X (FIG. 3) without fracturing or collapsing.

Figure 2:
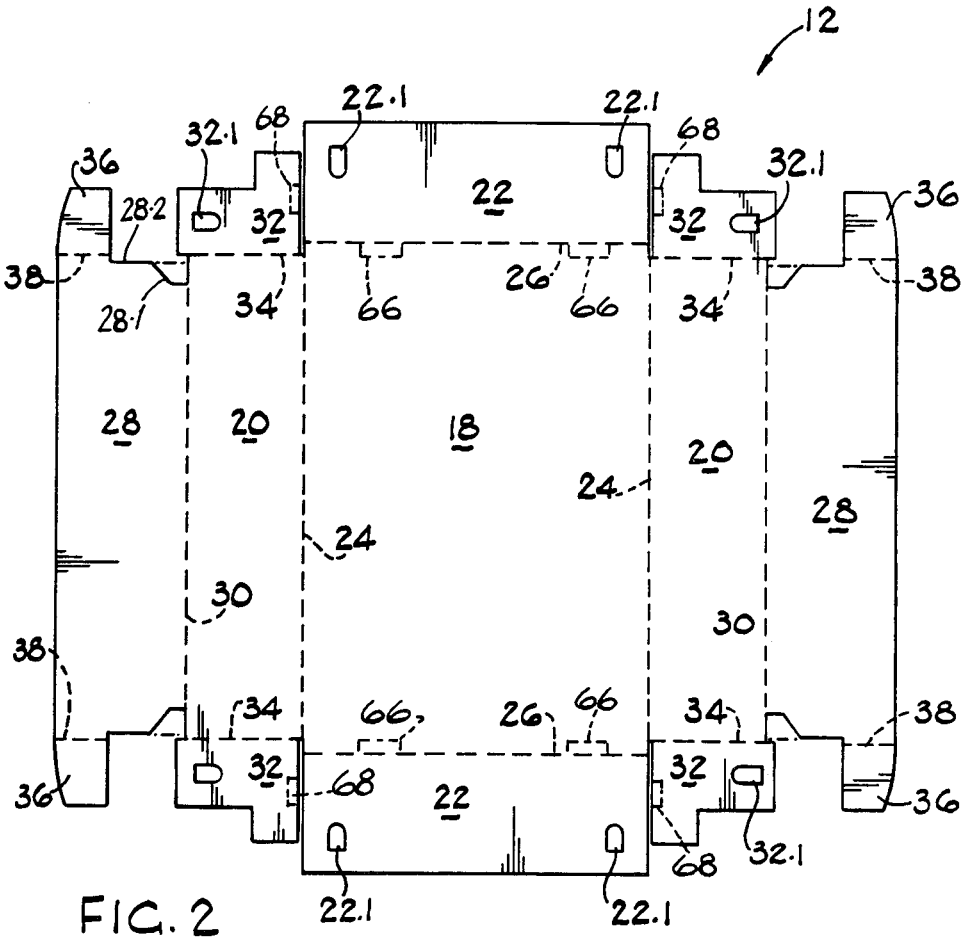
FIG. 2 illustrates a blank which constitutes the main component of the container of FIG. 1.

The blank 12 of FIG. 2 comprises a base panel 18, side panels 20, and end panels 22. Fold lines 24 form the boundaries between the panels 18 and 20 and fold lines 26 form the boundaries between the panels 18 and 22. Two apertures 22.1 are formed in each panel 22 for a purpose to be described. Two flaps 28 are joined to the side panels 20 along fold lines 30.

Locking panels 32 are provided at each end of each side panel 20, there being a fold line 34 between each panel 32 and the panel 20 to which it is joined. An aperture 32.1 is formed in each panel 32, these apertures being similar in shape and size to the apertures 22.1.

Tabs 36 protrude from each end of each flap 28 and are joined thereto along fold lines 38.

Figure 7:
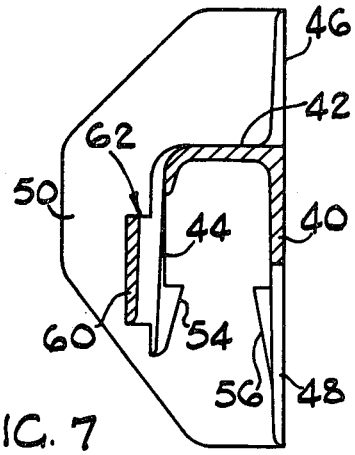
Figure 8:
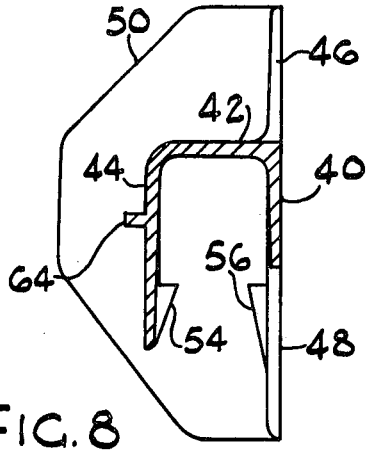

The box includes two identical end pieces 14. Each end piece, as shown particularly in FIGS. 6 to 8 is, in vertical section, of inverted U-shape and comprises a front wall 40 which lies outside the end panel 22 when the container is erected (see FIG. 1), a top wall 42 which overlies the end panel 22, insert 16 and locking panels 32, and an interior wall 44 which, when the container is erected, lies within the container and adjacent the locking panels 32.

Figure 3:
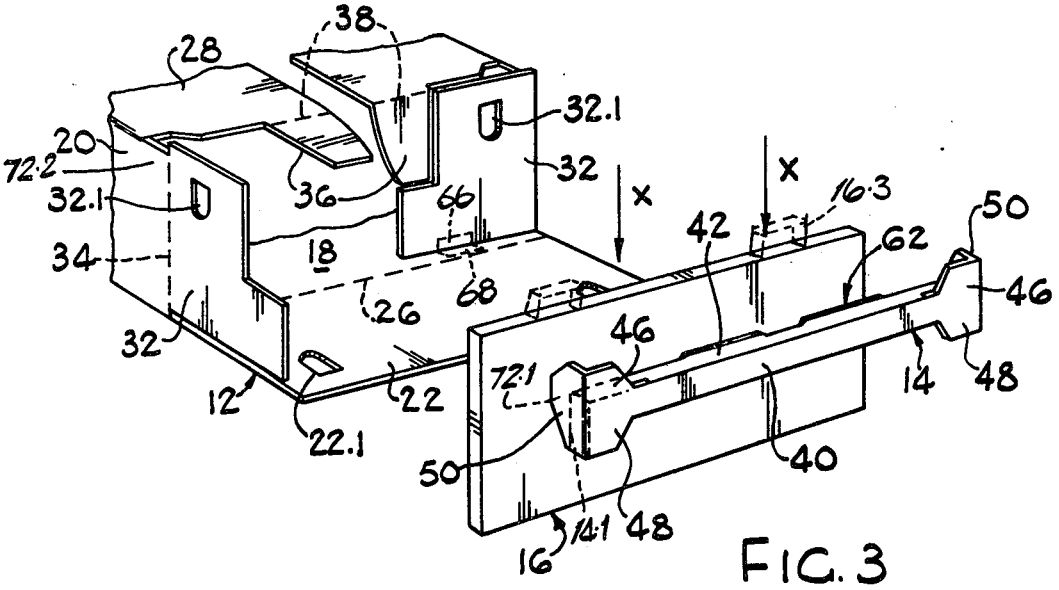
FIG. 3 is a view of one end of the container in 'exploded' condition.
Figure 4:
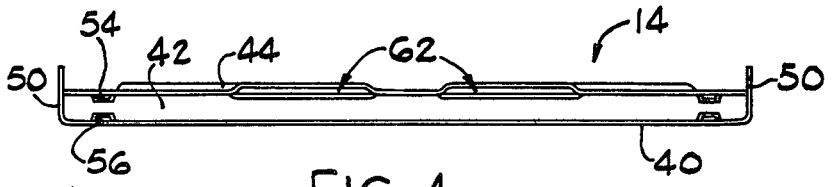
FIG. 4 is an underneath view of a moulded plastics end piece of the container.

The end portions of the exterior wall 40 are wider, measured in the vertical direction, that its central portion (see FIG. 3). This has the effect of providing an ear 46 at each end, these ears protruding upwardly above the level of the top wall 42 and also provides two ears 48 which protrude downwardly with respect to the central portion of the wall 40.

At each end of each end piece 14, arranged at right angles to the ears 46 and 48, there is an element 50 which is of approximately the same size and shape as the two ears 46 and 48, this element closing-off the ends of the downwardly open channel defined by the walls 40 to 44. Each ear 46 cooperates with the adjacent element 50 to form a right angled corner structure 52 which, as will be seen in FIG. 1, protrudes above the general level of the top face of the container. The top face of the container can be considered to lie generally in the plane of the upper faces of the flaps 28 and the upper faces of the top walls 42.

Figure 5:
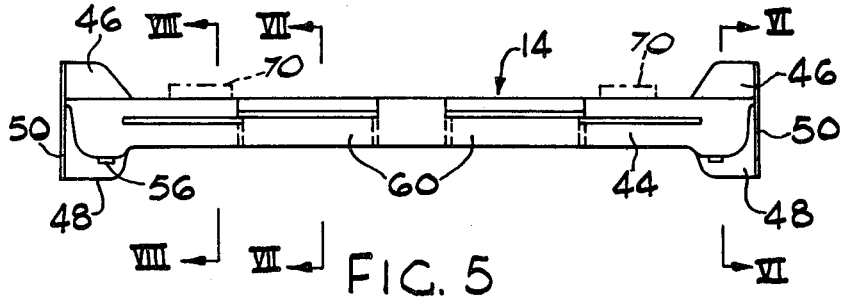
FIG. 5 is an elevation of the end piece of FIG. 4.
Figure 6:
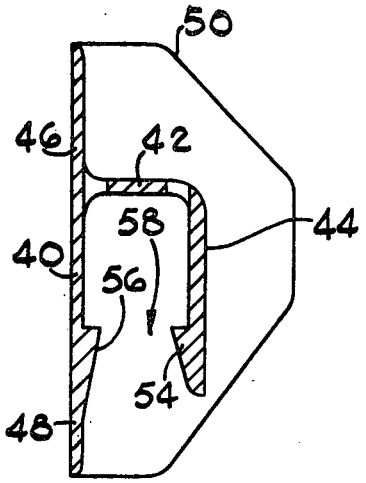
FIGS. 6 to 8 are sections on the lines VI—VI, VII—VII and VIII—VIII in FIG. 5, these sections being drawn to a larger scale than FIGS. 4 and 5.

If reference is now made particularly to FIG. 6, it will be noted that on the inner face of the lower edge of the interior wall 44 there is a protrusion 54 which faces a corresponding protrusion 56 projecting inwardly from the inner face of the lower ear 48. These protrusions define a gap 58 which tapers upwardly. From FIG. 7 it will be seen that the interior wall 44 includes two portions designated 60 (see also FIG. 5) which are displaced from the general, vertical plane of the remainder of the wall. The ends of these portions merge with the remainder of the wall and the configuration is such as to provide two upwardly open slots 62 (see also FIG. 4). If desired only one protrusion 56, somewhat larger than those illustrated, can be provided.

The procedure for erecting the container is as follows. The side panels 20 are folded through 90 degrees with respect to the base panel 18 about the fold lines 24. Thereafter the locking panels 32 at one end of the box are folded through 90° with respect to the panels 20 about the fold lines 34. In FIG. 3 one panel 32 (the right hand panel) is shown folded and the left hand panel is shown in its unfolded position. It will be noted from FIG. 2 that the fold lines 26 and 34 are not aligned with one another. The effect of this is that the panel 32, once folded to its vertical position, is spaced slightly inwardly from the fold line 26 as can best be seen in FIG. 3. Once both panels 32 are folded, the insert 16 is placed against their external face ie it rests on the portion of the panel 18 which is now between the panels 32 and the fold line 26, and then the panel 22 is folded upwardly about the fold line 26. Thus the insert 16 is now sandwiched between the panels 32 and the panel 22.

The next stage of the procedure is to press one of the end pieces 14 downwardly onto the structure thus far erected. The composite end wall consisting of the two panels 32, the insert 16 and the panel 22 enters the downwardly open channel of the end piece. Engagement between the protrusions 54 and 56, and the panels 32 and 22, splays the walls 40 and 44 apart until the apertures 22.1 and 32.1 come into registration with the four protrusions 54 and 56. The protrusions then snap into the apertures and the slightly splayed walls 40 and 44 return to their unstressed, parallel condition.

It will be noted that, while the protrusions taper upwardly, their upper faces lie in a common horizontal plane which is at right angles to the walls 40 and 44. Engagement between these faces and the horizontal upper edges of the apertures 22.1 and 32.1 locks the end piece in position and ensures that removal thereof is now impossible without damaging the container.

The other end of the container is erected in a similar manner and, after filling, the flaps 28 are folded about the fold lines 30 to close the container. Prior to so folding the flaps 28, the tabs 36 are folded about the fold lines 38 so that they lie at right angles to the flaps 28 (see the right hand tab in FIG. 3). Thus, as the flaps 28 are folded, the tabs 36 pass downwardly through the slots 62 the size of which is such as frictionally to retain the tabs 36 in position.

Once the container has been erected, filled and closed as described, it has the configuration shown in FIG. 1. When a further container of identical form is placed on top of it, such further container nests within the corner structures 52. These structures embrace and contact the lower corner portions of the panels 20 and 22 of the upper container which thus cannot slip laterally with respect to the lower container.

The top walls 42 are slightly above the level of the top flaps 28. Thus engagement between the upper and lower containers of the stacked pair is by way of the walls 42 and the transverse end portions of the base panel 18 of the upper container. It will be understood that the inserts 16 are above those portions of the panel 18 which contact the walls 42. Thus the load constituted by the upper container is directly carried by the end pieces 14 and inserts 16 of the lower container and not by any of the side panels or top flaps of the lower container.

When a number of containers as described are palletised, lateral movement is inhibited by virtue of the corner structures 52. These prevent any one container of the stack from sliding laterally with respect to other containers. Furthermore, the inserts 16 and end pieces 14 form load bearing columns which extend upwardly through the stack. There are two such load bearing columns for each vertical row of containers.

While not illustrated in the drawings, ventilation apertures are provided in the panels 18, 20, 22 and 28 to permit flow of air through the container. Air flow is promoted by virtue of the fact that the base panel 18 of an upper container of a stacked pair is slightly spaced from the upper faces of the flaps 28 of the lower container of the pair.

Short ribs 64 (see FIGS. 4 and 8) project inwardly from the wall 44. These, together with the aligned top edges of the portions 60 serve to prevent the flaps 28 being pressed inwardly after the container has been closed.

The specific configuration of the end portions of the flaps 28 that is illustrated makes it possible fully to open the container by bending these flaps, about the lines 30, to positions in which they project laterally from the box. In the absence of these cut-away ends, the flaps 28 could only open to a vertical position before striking the corner structures 52.

Figure 9:
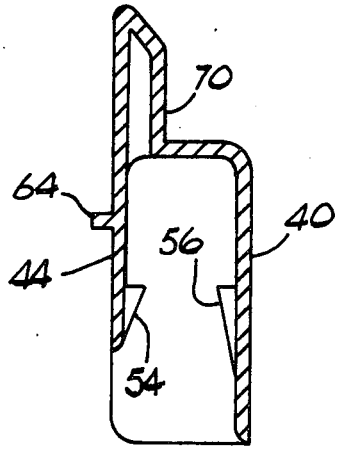
FIG. 9 is a further section on the line VIII—VIII in FIG. 5 and showing a modified construction.

A modified constructional form is shown in FIG. 9 and in chain-dotted lines in FIGS. 2, 3 and 5.

The blank 12 is modified by the provision of four apertures 66 (FIG. 2) in the panel 18 adjacent the lines 26, and four cut-outs 68 in the panels 32. The relationship of each aperture 66 to each cut-out 68 when the blank is being erected can be seen in FIG. 3 where one aperture 66 and one cut-out 68 are shown.

As regards the end pieces 14, these are modified by the removal of the structures 52 and replacement thereof by upwardly directed hollow tongues 70. These are shown in chain-dotted line in FIG. 5 and one is shown in section in FIG. 9. In FIG. 3 the shape of the left hand end of the piece 14 in this constructional form is illustrated in chain-dotted lines at 14.1.

In this form, the rib 64 extends the full length of the interior wall 44.

When two containers are stacked, the tongues 70 of the lower container extend upwardly through the apertures 66 of the panel 18 of the upper container. Interengagement of the tongues 70 with the container above prevents relative movement between the two containers.

In a further modified form, the insert 16 is formed with two upwardly projecting tongues 16.3 (see FIG. 3) which enter the hollow tongues 70 from below and serve to strengthen these hollow tongues. An advantage of this arrangement is that tilting of the insert 16 is inhibited by engagement between the tongues 16.3 and the inner faces of the tongues 70. In yet another form, the tongues 70 are omitted and replaced by slots through which the tongues 16.3 on the insert 16 project. In this form the tongues form the inter-locking means.

It is also possible to provide, at the regions 72.1 and 72.2 (FIG. 3) of the piece 14 and panel 20, an inwardly directed pin on the element 50 and an aperture in the panel 30 respectively. Engagement between the pin and aperture inhibits tilting of the lower edge of the wall 40 of the end piece 14 outwardly with respect to the panel 22.

In the absence of the corner structures 52, the cutaways shown at 28.1 (FIG. 2) can be omitted. These are provided in the FIG. 1 embodiment so that the flaps 28 clear the corner structures 52 when the container is opened. The edges 28.2 then continue, as shown by the chain-dotted lines in FIG. 2, to the line 24.

A further possible modification consists in shifting the slots 62 and providing edges which slightly overhang them. In this form, the panels 28 are distorted slightly as the tabs 36 slide downwardly through them. As the tabs fully enter the slots, the panels 28 straighten so that their end edges pass beneath overhanging edges of the end pieces.

I claim:

1. A container comprising a base panel, upstanding side panels and upstanding end panels, said panels forming an upwardly open tray, a locking panel at each end of each side panel, each pair of locking panels being parallel to and spaced from the adjacent end panel, a load bearing insert at each end of the container, each insert being between one of the end panels and the two adjacent locking panels, each insert, adjacent end panel and adjacent pair of locking panels forming a composite end wall of the container, and an end piece of inverted U-shape at each end of the container, the vertical walls of each end piece receiving the upper edge of one of the composite end walls therebetween, and elements which protrude upwardly at each end of the container with respect to the remainder of the container.

2. A container according to claim 1, in which said elements are corner structures at each end of each piece, each corner structure being right-angled in plan view with a first portion thereof extending transversely of the container and a second portion thereof extending longitudinally of the container.

3. A container according to claim 1, in which said elements are tongues which project upwardly from the upper faces of the end pieces inwardly of the ends thereof.

4. A container according to claim 3, in which said insert also has tongues, said tongues of said element are hollow and downwardly open, and the tonques of the insert project upwardly into the tongues of said element.

5. A container according to claim 1, in which said elements are tongues of said insert which project upwardly through slots provided in said end pieces.

6. A container according to claim 1, and further including top flaps for closing the upwardly open tray after it has been filled.

7. A container according to claim 6, in which each top flap is connected to a side panel.

8. A container according to claim 6, in which at each end of each top flap there is a tab, said tabs, when the flaps are in the closed position, projecting downwardly adjacent the composite end walls.

9. A container according to claim 8, in which said end pieces are formed with horizontally extending, upwardly open slots for receiving said tabs.

10. A container according to claim 1, in which at least one of those faces of the vertical walls of each end piece which are directed towards one another is formed with a protrusion, said end panels or said locking panels or both being formed with apertures which said protrusion or protrusions enter as the end pieces are engaged with the composite end walls thereby to lock the end pieces to the composite end walls.

11. A container according to claim 1, in which said locking panels lie inwardly of said end panels.

* * * * *